United States Patent [19]

Hayduk

[11] 4,106,642

[45] Aug. 15, 1978

[54] COKE PUSHING DEVICE

[75] Inventor: Harry Nicholas Hayduk, Pittsburgh, Pa.

[73] Assignee: Koppers Company, Inc., Pittsburgh, Pa.

[21] Appl. No.: 818,392

[22] Filed: Jul. 25, 1977

[51] Int. Cl.[2] ..... C10B 39/14

[52] U.S. Cl. ..... 214/18 R; 202/262

[58] Field of Search ..... 214/23–34, 214/18 R, 18 PH; 202/262, 263

[56] References Cited

U.S. PATENT DOCUMENTS

| | | | |
|---|---|---|---|
| 916,200 | 3/1909 | Rouse et al. | 214/33 |
| 2,894,649 | 7/1959 | Malkomes | 214/23 |

*Primary Examiner*—Albert J. Makay

*Attorney, Agent, or Firm*—R. Lawrence Sahr; Oscar B. Brumback

[57] ABSTRACT

A device for moving coke away from the coke guide and leveling coke in a one-spot quench car is disclosed. A plow is mounted on a coke guide car just below the exit end of the coke guide. The plow is connected to extension apparatus to project it outward from the coke guide, across the hopper of a one-spot quench car. As the one-spot quench car is being filled with coke, the plow is extended to push the coke away from the coke guide to provide additional space for more coke. When the one-spot quench car is filled, the plow is again extended to level the coke to enhance quenching operations. The plow is then retracted and the one-spot quench car is relocated.

6 Claims, 5 Drawing Figures

COKE PUSHING DEVICE

BACKGROUND OF THE INVENTION

1. Field of the Invention

This invention relates to the increasing use of one-spot quench cars in horizontal coke oven battery operations wherein the discharge of coke from a coke oven into a coke quench car is required to be sealed from the atmosphere to prevent escape of noxious gases. One means for sealing the discharge operation is to enclose the coke guide car and the coke quench car with a hood. To enable the use of a hood the coke quench car must remain stationary, thus the term of art has developed denominating such a car as a "one-spot" coke quench car. Specifically, this invention relates to a means for evenly distributing the coke loaded into a one-spot quench car.

2. Description of the Prior Art

The original mode of operation of a horizontal coke oven battery included discharging of the coke into a quench car which was slowly drawn past the end of the coke guide as the coke dropped into the hopper of the quench car. In this manner the coke was fairly evenly dispersed throughout the hopper. However, the discharge operation was not sealed and the gases from the hot discharging coke were expelled into the atmosphere.

Recent studies have made the coke industry aware of the problems inherent with coke discharge gases being expelled into the atmosphere, resulting in measures being taken to prevent those problems. A major approach to the problem has been to contain the discharge gases followed by cleaning them of their obnoxious impurities before expulsion into the atmosphere.

A prevalent method of containing the coke discharge gases is to enclose the whole discharge system, including the coke oven door, the coke guide car and the coke quench car. However, this method prevents the slow progression of movement of the coke quench car past the coke guide. Therefore, a quench car is called for that remains stationary while being filled with discharging coke. This concept, and the car, are denominated as a "one-spot quench car" system.

Because of one-spot coke quench car remains stationary, there is a problem in evenly dispersing the coke in the hopper of the car. The coke ejected from a coke oven is in the form of rather large blocks or chunks which are brittle and friable. These blocks or chunks must be evenly dispersed within the coke quench car. If the coke is not dispersed to the remote ends of the car during the discharge operation, the coke piles up in front of the coke guide exit and blocks the further discharge of coke. If the coke is not evenly dispersed in the quench car when the coke is quenched, an uneven cooling of the coke results, causing a diminishment in the quality of coke produced. Attempts have been made to incorporate deflectors into the path of the coke as it moves from the coke guide into the one-spot quench car but these have proved to be unsatisfactory as they limit the overall capacity of the quench car, do not adequately break up the blocks of coke, and prevent coke from being evenly dispersed just in front of the coke guide exit.

Other attempts have been made to redesign the quench car hopper to make it shorter yet deeper and wider. Such attempts have proved practical in new coke oven battery installations where everything can be designed to accommodate the radically redimensioned quench cars. However, this approach is economically impractical for modification of existing coke oven batteries. The reason is that the vertical distance from the bottom of the coke guide down to the track level of the quench car is preset. Also, the height of the coke wharf, where the coke is dumped from the quench car, above the same track level, is also preset.

There is a need to provide a means for evenly dispersing the coke throughout the hopper of a one-spot coke quench car which can be economically incorporated into existing coke oven batteries for use with standard sized coke quench cars enabling their use in the one-spot method of coke discharge.

SUMMARY OF THE INVENTION

The present invention provides a means, capable of being mounted on existing coke guide equipment, for evenly dispersing the coke throughout the hopper of a one-spot coke quench car. A means for pushing the coke is mounted adjacent to the bottom of the exit from the coke guide on a coke guide car. A means for projecting advances the pushing means outward from the coke guide in a direction across the one-spot coke quench car. At the point where the pushing means is above the hopper of the one-spot quench car, that pushing means is dropped into the hopper, and further projected across the hopper, dispersing the coke before it. The pusher means is then raised and retracted to its starting position adjacent to the bottom of the exit from the coke guide. This cycle is repeated as required to evenly disperse the coke throughout the hopper of a one-spot quench car.

Accordingly, one of the principal features of the present invention is to provide an economical means, readily adaptable to existing coke oven batteries, by which coke can be cleared away from in front of the coke guide in a one-spot quench car, thus allowing additional coke to be discharged into that car.

Another feature of the present invention is to provide an economical means by which coke can be evenly dispersed in a one-spot coke quench car to enhance the quenching operation, resulting in higher quality coke.

These and other features of the present invention will be more completely disclosed and described in the following specification, the accompanying drawings and the appended claims.

DETAILED DESCRIPTION

Figure 1:
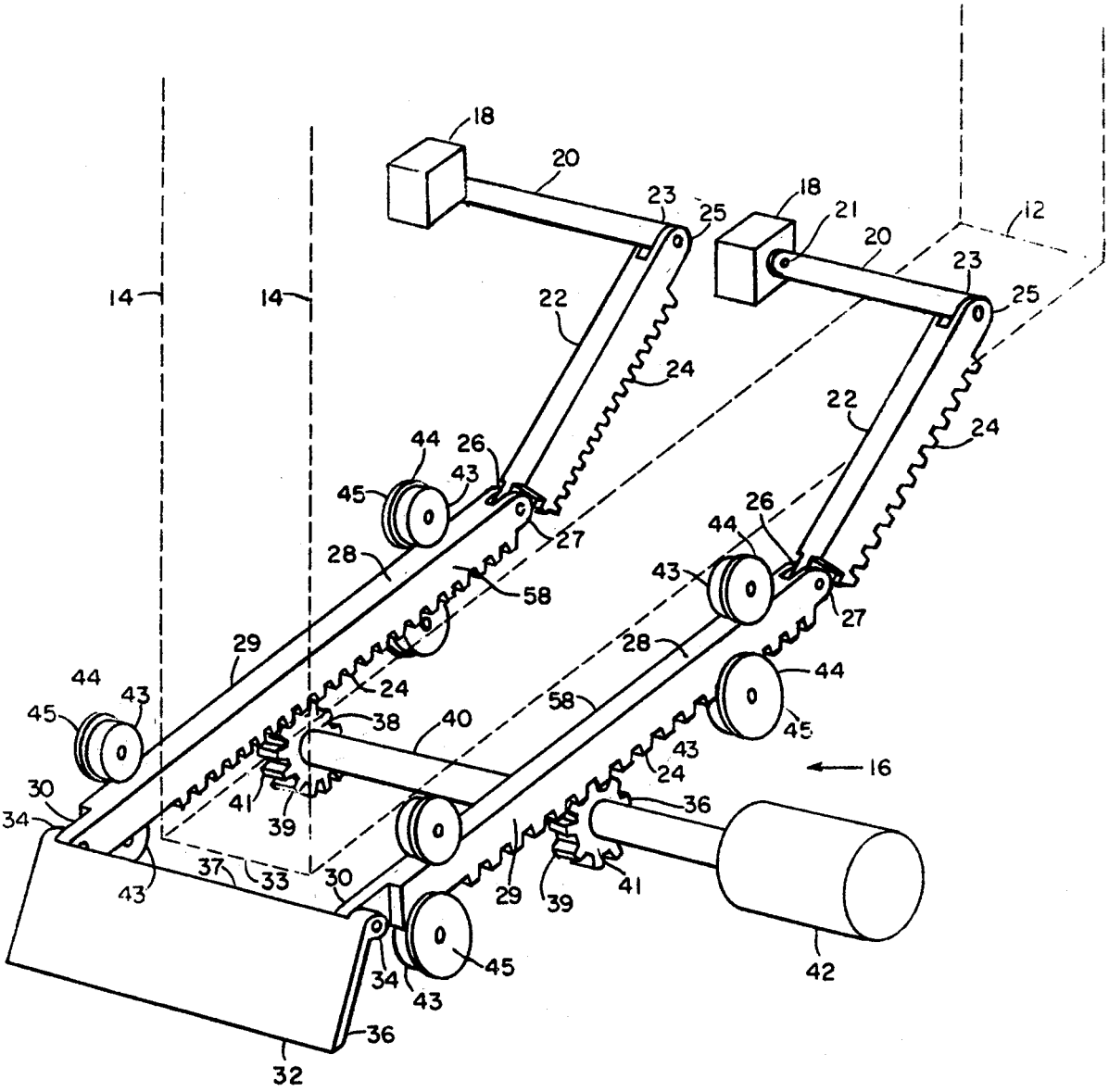
FIG. 1 is a three dimensional projection of the coke pushing device in a partially extended posture, shown as positioned about the silhouette of a coke guide.

Referring to FIG. 1 of the drawings, there is illustrated, in silhouette, a coke guide, generally designated by the numeral 10. The coke guide 10 is composed of a horizontal floor, generally designated by the numeral 12, and a pair of vertical walls, generally designated by the numeral 14. Positioned beneath the elevation coke guide 10 and symmetrically arranged in relation to the walls 14 is the coke pushing device, generally designated by the numeral 16.

As illustrated in FIG. 1, a mounting means, generally designated by the numeral 18, is fixed to the exterior of each of the walls 14. Those skilled in the art will comprehend that the mounting means can be any of many commonly known devices such as, for example, a bracket or a block. A link 20 is pivotally mounted to each mounting means 18. In the preferred embodiment, as illustrated in FIG. 1, each link 20 is shaped from a linear steel bar with semi-circular ends. The links 20 are mounted such that they can pivot in planes which are parallel to each other. The point of pivotation of each link, which is pivotally mounted to the mounting means 18, is located at the first end 21 of each link.

The second end 23 of each link 20 is pivotally mounted within the slotted end 25 of an articulated rack 22. Each articulated rack 22 has, generally, a rectangular cross section with a plurality of straight cut gear teeth 24 positioned along one side of that rectangle. The gear teeth 24 are arranged parallel to each other in a repetitive pattern, each gear tooth 24 being perpendicular to the linear axis of each of the articulated racks 22. The repetitive pattern of gear teeth 24 does not extend fully to the slotted ends 25 of the articulated racks 22. The end of each articulated rack 22 which is opposite to the slotted end 25 is formed by a key projection 26. The key projection 26 of each articulated rack 22 is formed by an extension of that articulated rack 22 which is reduced in width from the width of the articulated rack 22, the width of the articulated rack 22 being equivalent to the length of each of the gear teeth 24. Both the slotted end 25 and the key projection 26 of each articulated rack 22 are semi-circular shaped.

Each key projection 26 is pivotally mounted within the slotted end 22 of an extensible rack 28. The cross-sectional shape and dimensions of the extensible rack 28 are equivalent to that of the articulated rack 22. Gear teeth 24 are positioned along one side of the extensible rack 28 in a manner identical to the positioning of the gear teeth 24 on the articulated rack 22. The pivotal connection of the key projection 26 of the articulated rack 22 to the slotted end 27 of the extensible rack 28 is such that the articulated rack 22 can be pivoted to a position in which it forms a linear extension of the extensible rack 28. When the articulated rack 22 is moved to this position the gear teeth 24 of the articulated rack 22 and the extensible rack 28 form a coextensive continuous pattern, the gear teeth 24 of the extensible rack 28 being positioned on that side of the extensible rack 28 coextensive with that side of the articulated rack 22 upon which gear teeth 24 are positioned. The slotted end 27 of the extensible rack 28 is semi-circular shaped for pivotational clearance in relation to the articulated rack 22. Likewise the key projection 26 which forms one end of the articulated rack 22 is semi-circular shaped for clearance in relation to the extensible rack 28. Thus, the articulated rack 22 and the extensible rack 28 form a bifurcated continuum.

The end of each extensible rack 28 which is opposite to the slotted end 27 is formed by a dog 30. The dog 30 is an extension of each of the extensible racks 28 which is recessed such that its width is less than the width of the corresponding rack 28. The side of each dog 30 which faces the coke guide 10 is coextensive with the corresponding side of that extensible rack 28, the recessed side of the dog 30 being on the opposite side of each of the extensible racks 28. The link 20, the articulated rack 22 and the extensible rack 28 combinations are arranged outboard from each of the respective walls 14 of the coke guide, as illustrated in FIG. 1.

A coke plow 32 is positioned just below the leading edge 33 of the floor 12 of the coke guide 10. In the preferred embodiment the coke plow is formed from a steel plate rectangular in shape. The rectangular length of the coke plow 32 is horizontal and extends equidistantly beyond each of the walls 14 of the coke guide 10 and is generally equal to the distance separating the extensible racks 28.

A lug 34 is fixed to the rear face 36 of the coke plow 32, adjacent to the corner formed by the axial edge 37 and one end of the coke plow 32. A lug 34 is also fixed to the rear face 36 of the coke plow 32 adjacent to the corner formed by the axial edge 37 and the opposite end of the coke plow 32. The lugs 34 are semi-circular in shape. Each of the lugs is pivotally mounted to the dog 30 of each of the extensible racks 28 such that a common axis is formed between the two lugs 34. The lugs 34 are sufficient in width to compensate for the difference in width between the dog 30 and its corresponding extensible rack 28. The semi-circular shape of the lugs 34 provides clearance in respect to the extensible racks 28 for purposes of pivotation.

A pinion 38 is positioned below each extensible rack 28, as illustrated in FIG. 1. Each pinion 38 embodies about its periphery a plurality of pinion teeth 39 which conform in size and shape to the gear teeth 24. The positioning of each pinion 38 is such that the pinion teeth 39 engage the gear teeth 24. The faces of the pinions 38 are aligned parallel to each other. A linear drive shaft 40 projects through the diametrical center of each pinion 38 forming a common axis of rotation for those pinions. The drive shaft 40 extends, beyond the outboard faces 41 of the pinions 38, through pillow block bearings (not shown). One end of the drive shaft 40 is rotatably connected to a drive means, generally designated by the numeral 42. Those skilled in the art will recognize that the drive means can be one of many commercially available devices used to generate slow speed, high torque rotation such as, for example, a gear reduced electric motor.

Figure 2:
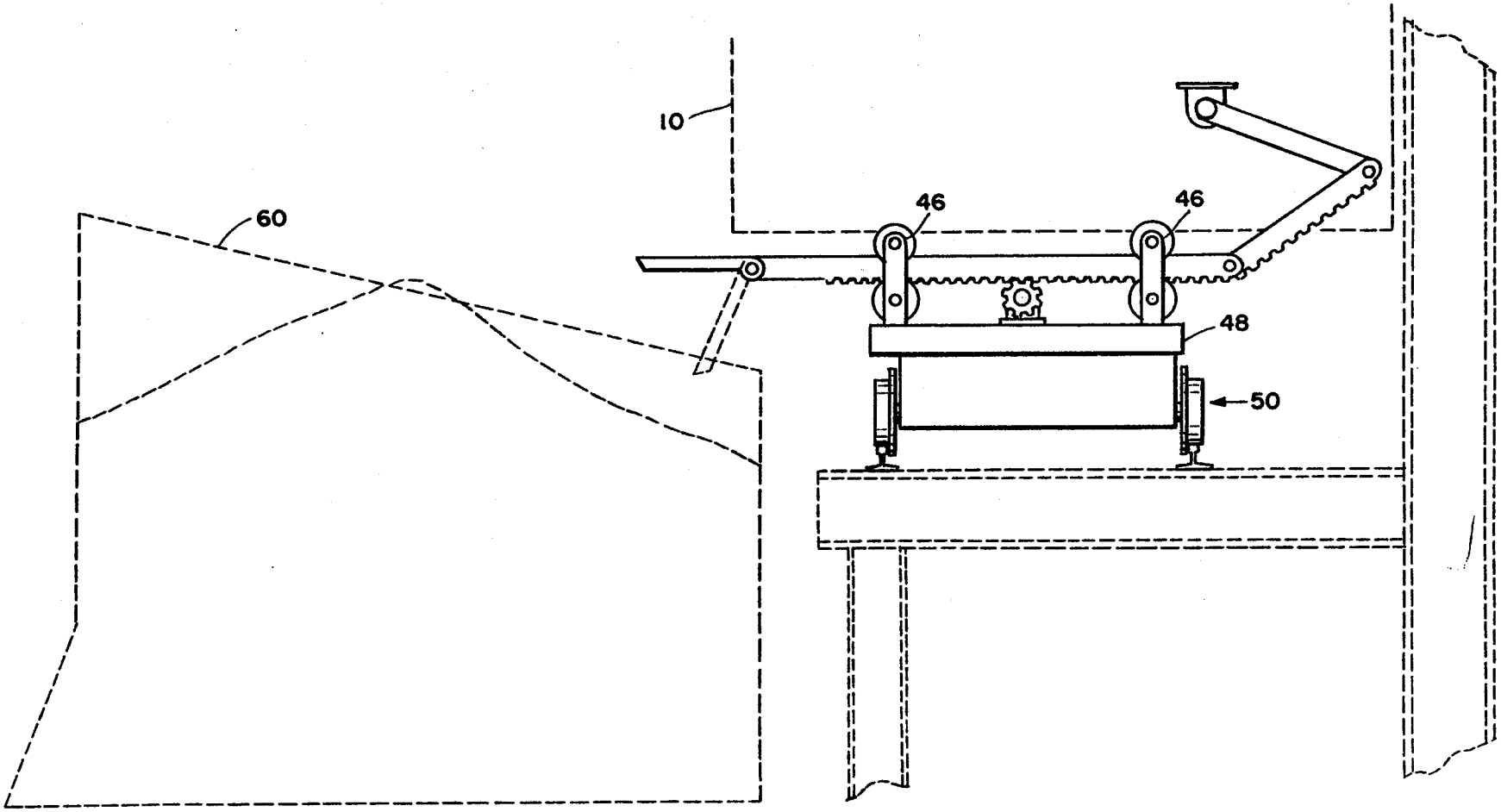
FIG. 2 is a side view of the coke pushing device in relation to the frame of the coke guide car and the one-spot coke quench car, showing the arc of pivotation of the coke plow.
Figure 3:
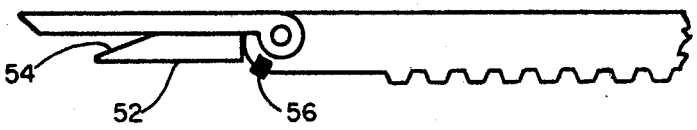
FIG. 3 is a side detail view of the plow in the raised position demonstrating the position of the fixed plate support in relation to the plow at this position.

Guide rollers 43 are positioned about each of the extensible racks 28. The guide rollers 43 are generally cylindrical in shape, the central axis of each running perpendicular to the linear axis of the extensible racks 28. Thus, the central axis of the guide rollers 43 are aligned parallel to each other. A flange 44 is fixed to the outboard end 45 of each guide roller 43. Each of the guide rollers 43 is positioned such that its cylindrical periphery contacts a side of an extensible rack 28. The guide rollers 43 are positioned in vertical pairs, one above and one below a given point on an extensible rack 28. The flanges 44 of the guide rollers 43 contact the outboard sides 29 of the extensible racks 28, as illustrated in FIG. 1. The vertical pairs of guide rollers 43 are each mounted to a bracket 46 common to that pair, as shown in FIG. 2. Each of the brackets 46 is fixed to a frame 48 which serves as the main structural member of a coke guide car 50. The coke guide 10 is, likewise, fixed to the frame 48.

Figure 4:
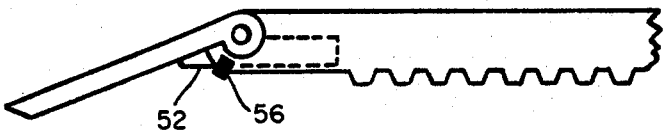
FIG. 4 is a side detail view of the plow in a partially lowered position demonstrating the position of the fixed plate support in relation to the plow at this position.
Figure 5:
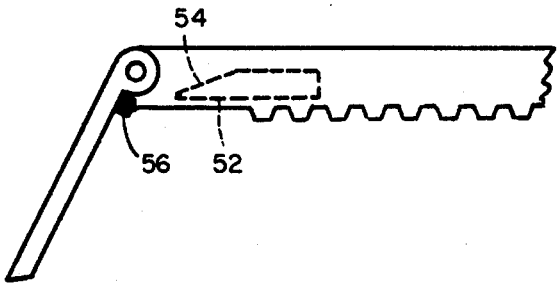
FIG. 5 is a side detail view of the plow in a fully lowered position demonstrating the position of the fixed plate support in relation to the plow at this position.

A plow support 52 is fixed to the frame 48 directly below the leading edge 33 of the floor 12. In the preferred embodiment the plow support is a modified rectangular bar of steel, in length, less than the distance separating the extensible racks 28. The modification to the rectangular cross section of the plow support is found in a beveled leading edge 54 of the plow support 52, as illustrated in FIG. 4.

A stop 56 is fixed to the dog 30 of each extensible rack 28 such that the coke plow 32 is prevented from pivoting downward past the point where it is vertical. Each stop 56 is positioned on the inboard side 58 of each respective extensible rack 28.

At the point in time when the coke-making process is finished within a coke oven, the coke side door, not shown, is removed, and the coke guide car 50 is positioned such that the coke guide 10 is aligned with the open coke oven (not shown). A coke quench car 60 is centrally positioned below the coke guide 10, as illustrated in FIG. 2. A pusher (not shown) operates on the opposite side of the coke oven (not shown) pushing the coke through the coke guide 10 into the coke quench car 60. As the coke accumulates in the coke quench car 60 it mounds up in its center. The mound of coke soon is raised above the level of the coke quench car 60. At this point the drive means 42 is engaged, rotating the drive shaft 40 which in turn rotates the pinions 38. The pinion teeth 39 engaged in the gear teeth 24 of the extensible racks 28 push the extensible racks 28 forward in the direction of the coke quench car 60. The coke plow 32, initially in the horizontal position, held there by the plow support 52, is slid across the plow support 52 and across the leading edge 54 of the plow support 52. This motion causes the coke plow 32 to exceed to gravitational forces, pivoting downward to a point where it engages the stops 56. As the plow is moved further, in this direction, the articulated racks 22 are pivoted about the slotted ends 27 of the extensible racks 28 to a point where the articulated racks 22 become linearly coextensive with the extensible racks 28. At this point the extensible racks 28 contact pairs of guide rollers 43 which maintain the articulated racks 22 in that position as linear coextensions of the extensible racks 28. Rotation of the pinions 38 continues. As the articulated racks 22 are drawn adjacent to the pinions 38 the pinion teeth 39 engage the continuous patterns of gear teeth 24 along the sides of the articulated racks without interrupting the extension motion of the coke plow 32. The guide rollers 43 serve to direct and support the extensible racks 28 and, later, the articulated racks 22 as they are moved across the pinions 38. At the point where the coke plow 32 reaches the far side of the coke quench car 60 the direction of rotation of the drive means 42 is reversed and the coke plow is retracted back towards the coke guide 10. At the point where the axial edge 37 of the coke plow 32 reaches the leading edge 54 of the plow support 52, the plow support 52 causes the coke plow 32 to pivot back to a horizontal position as the coke plow 32 is forced across the top of the plow support 52.

The sequence of motion is repeated at various points as the coke mounds up in the coke quench car 60. When all of the coke has been pushed from the coke oven (not shown) into the coke quench car 60, the sequence of motion of the coke plow 32 is repeated one final time to finally level the coke in the coke quench car 60.

According to the provisions of the patent statute, the principle, preferred construction and mode of operation of the present invention have been illustrated and its best embodiment has been described. However, it is to be understood that within the scope of the appended claims, the invention may be practiced otherwise than as specifically illustrated and described.

What is claimed is:

1. In a horizontal coke oven battery, in combination with a coke guide and a coke guide car, means for spreading and leveling coke pushed from a coke oven through said coke guide into a one-spot coke quench car comprising:

(a) pusher means positioned adjacent the leading edge of the floor of said coke guide;

(b) projecting means by which said pusher means can be extended outwardly from said leading edge of said floor of said coke guide across the width of said one-spot coke quench car which has been positioned to receive said coke;

(c) pusher positioning means by which said pusher means can be diverted into said one-spot coke quench car to engage said coke therein; and (d) retraction means by which said pusher means can be withdrawn from within said one-spot quench car and retracted toward said leading edge of said floor of said coke guide.

2. The combination as set forth in claim 1 wherein:

(a) said pusher means is a coke plow pivotally mounted to said projecting means; and (b) said pusher positioning means is a plow support fixed to said coke guide car beneath the elevation of said pivotal mounting of said coke plow and positioned beneath said leading edge of said floor of said coke guide.

3. The combination as set forth in claim 1 wherein said projecting means comprises:

(a) a plurality of rectilinear racks pivotally connected to said pusher means, said racks being aligned parallel to each other, said racks having formed thereon, along one side thereof, gear teeth, said racks being positioned at an elevation below said leading edge of said floor of coke guide;

(b) a plurality of pinions, one each of which is engaged with said gear teeth of one of said racks; and (c) means to drive said pinions in unison.

4. The combination as set forth in claim 3 wherein:

(a) said pusher means is a coke plow pivotally mounted to said plurality of rectilinear racks;

(b) said pusher positioning means is a plow support fixed to said coke guide car beneath the elevation of said pivotal mounting of said coke plow and positioned beneath said leading edge of said floor of said coke guide; and (c) said retraction means is means to reverse said means to drive said pinions in unison to retract said coke plow and withdraw said coke plow across said plow support pivoting said coke plow from within said coke quench car.

5. The combination as set forth in claim 4 further comprising guide means to support and hold rigid said plurality of rectilinear racks.

6. The combination as set forth in claim 4 wherein said rectilinear racks are bifurcated to fold up when said coke plow is retracted and to open up to form a straight line when said coke plow is projected.

* * * * *